US011491792B2

(12) United States Patent
Cappello

(10) Patent No.: US 11,491,792 B2
(45) Date of Patent: Nov. 8, 2022

(54) MODULAR SERVICE STATION AND A METHOD OF SERVICING AN INKJET PRINTHEAD OF AN INKJET PRINTING SYSTEM

(71) Applicant: SICPA HOLDING SA, Prilly (CH)

(72) Inventor: Paolo Cappello, Romano Canavese (IT)

(73) Assignee: SICPA HOLDING SA, Prilly (CH)

( * ) Notice: Subject to any disclaimer, the term of this patent is extended or adjusted under 35 U.S.C. 154(b) by 0 days.

(21) Appl. No.: 17/265,069

(22) PCT Filed: Jul. 18, 2019

(86) PCT No.: PCT/EP2019/069414

§ 371 (c)(1),
(2) Date: Feb. 1, 2021

(87) PCT Pub. No.: WO2020/025347

PCT Pub. Date: Feb. 6, 2020

(65) Prior Publication Data

US 2021/0300046 A1 Sep. 30, 2021

(30) Foreign Application Priority Data

Jul. 30, 2018 (EP) ..... 18186266

(51) Int. Cl.
*B41J 2/165* (2006.01)

(52) U.S. Cl.
CPC ..... *B41J 2/16535* (2013.01); *B41J 2/16511* (2013.01)

(58) Field of Classification Search
CPC ..... B41J 2/16535; B41J 2/16511; B41J 2/16588; B41J 2/16508; B41J 2/16538
See application file for complete search history.

(56) References Cited

U.S. PATENT DOCUMENTS 5,455,609 A 10/1995 Gast et al.
6,174,041 B1 1/2001 Urrutia et al.
(Continued)

FOREIGN PATENT DOCUMENTS

CA 2364401 6/2003
CN 1772489 5/2006
(Continued)

OTHER PUBLICATIONS

International Search Report and Written Opinion issued with respect to application No. PCT/EP2019/069414.
(Continued)

*Primary Examiner* — Sharon Polk
(74) *Attorney, Agent, or Firm* — Muncy, Geissler, Olds & Lowe, P.C.

(57) ABSTRACT

A modular service station for servicing at least one inkjet printhead of an inkjet printing system, the service station comprising: a frame with mounted thereon at least one capping element and at least one wiping element, a means for horizontal movement of the at least one inkjet printhead between a printing position and a servicing position, the means for horizontal movement configured to enable a wiping process, a means for vertical movement of the at least one inkjet printhead, the means for vertical movement configured to enable capping, unclogging or purging processes in respect to the at least one inkjet printhead, and a waste ink tank in hermetic communication with the at least one capping element. A method of servicing an inkjet printhead of an inkjet printing system is also disclosed.

15 Claims, 7 Drawing Sheets

(56) References Cited

U.S. PATENT DOCUMENTS

| | | | | |
|---|---|---|---|---|
| 2004/0174409 | A1* | 9/2004 | Park | B41J 2/16547 347/32 |
| 2006/0098040 | A1 | 5/2006 | Kang | |
| 2007/0103505 | A1 | 5/2007 | Takagi | |
| 2013/0008333 | A1 | 1/2013 | Peter et al. | |
| 2017/0253046 | A1 | 9/2017 | Moscato et al. | |
| 2018/0264826 | A1* | 9/2018 | Karppinen | B41J 2/16552 |

FOREIGN PATENT DOCUMENTS

| | | | | |
|---|---|---|---|---|
| CN | 1962270 | | 5/2007 | |
| CN | 102844193 | | 12/2012 | |
| CN | 204431972 | | 7/2015 | |
| EP | 590850 | A2 * | 4/1994 | B41J 2/16547 |
| EP | 3056346 | A2 | 8/2016 | |
| JP | 2003094689 | | 4/2003 | |
| WO | 2015/159659 | A1 | 10/2015 | |
| WO | 2018074990 | | 4/2018 | |

OTHER PUBLICATIONS

International Preliminary Report on Patentability issued with respect to application No. PCT/EP2019/069414.

First Office Action and Search Report issued in corresponding Chinese Application No. 201980050888.0 dated Mar. 9, 2022 (and English language translation of the Office Action).

* cited by examiner

MODULAR SERVICE STATION AND A METHOD OF SERVICING AN INKJET PRINTHEAD OF AN INKJET PRINTING SYSTEM

TECHNICAL FIELD

The present invention relates to the technical field of a printing technology, in particular to a modular service station for servicing at least one inkjet printhead of an inkjet printing system and to a method of servicing an inkjet printhead of an inkjet printing system.

BACKGROUND ART

Printers known from the prior art usually have service stations which are formed as an integral part of the printer equipment and are not suitable for easy replacement in case of need. They also cannot be customized for specific servicing operation. Moreover, even if they could be purchased separately, they would not be proprietary and could cause revealing of some confidential technical information, which is not acceptable.

Accordingly, some prior art solutions made attempts to improve the service station adaptability and replaceability, enabling the use of the service station in different printer applications.

U.S. Pat. No. 5,455,609 discloses an improved modular service station design wherein a printhead-servicing sled is vertically driven to effect execution of servicing tasks. To save time and space, both the printhead and the servicing mechanism such as the wipers and the caps are moved so as to place them in proper relative positions for execution of a task. Since the servicing of the printhead is performed by vertical movement of both the printhead and the servicing mechanism, there is a risk that the repeated activation of the nozzles, either to remove the clogs or to eliminate possible obstructions in the fluidic circuit, will cause the ejection of some ink, which produces unwanted dots or stains onto the printing medium. Moreover, said structure is still rather complex, since requires to ensure driving of both the printhead and the servicing mechanism, as well as proper alignment thereof, and requires more time for assembling, higher manufacturing and design costs, and thus leads to higher final purchase price.

U.S. Pat. No. 6,174,041 discloses a modular printhead service station with self-contained motorized components, wherein an inkjet printer service carriage moves between a first position in which the carriage is remote from the printhead cartridges to be serviced and a second position in which the service carriage abuts the printhead carriage to service the printheads and includes two independent motorized actuators, the first of which linearly moves the service carriage in a horizontal x-axis direction and the second of which arcuately moves the carriage in a vertical z-axis plane perpendicular to the x-axis direction. Since only the service carriage is movable with respect to the printhead, there is a risk that the repeated activation of the nozzles, either to remove the clogs or to eliminate possible obstructions in the fluidic circuit, will cause the ejection of some ink, which produces unwanted dots or stains onto the printing medium. Moreover, the disclosed structure is rather complex to manufacture, since it requires two independent motorized actuators moving the service carriage in the linear horizontal direction and in the vertical arcuate plane, increasing the complexity of the required parts and associated manufacturing costs.

It is therefore an object of the present invention to overcome the shortcomings of the prior art and to provide a simple, compact, efficient, customizable and cost-effective modular service station for servicing an inkjet printhead of an inkjet printing system, which enables to avoid unwanted dots or stains onto the printing medium during the servicing operation, is capable to efficiently perform wiping, purging and capping of the printhead, and can fit to any length of the printhead. Another object of the invention is to provide a respective method of servicing an inkjet printhead of an inkjet printing system, which ensures achievement of the above-mentioned advantageous effects.

SUMMARY OF THE INVENTION

According to one aspect, the present invention relates to a modular service station for servicing at least one inkjet printhead of an inkjet printing system, the service station comprising:

- a frame with mounted thereon at least one capping element for capping the at least one inkjet printhead and at least one wiping element, preferably a wiping blade, for wiping the at least one inkjet printhead,
- a means for horizontal movement of the at least one inkjet printhead between a printing position and a servicing position, the means for horizontal movement configured to enable a wiping process by bringing in contact a surface of the at least one inkjet printhead and the at least one wiping element during the horizontal movement of the at least one inkjet printhead back and forth,
- a means for vertical movement of the at least one inkjet printhead, the means for vertical movement configured to enable capping, unclogging or purging processes in respect to the at least one inkjet printhead, and
- a waste ink tank in hermetic communication with the at least one capping element.

In one aspect of the invention, the means for horizontal movement of the at least one inkjet printhead and the means for vertical movement of the at least one inkjet printhead are a horizontally movable motorized sled and a vertically movable motorized sled, respectively.

The horizontally movable motorized sled is fixed to the frame and the vertically movable motorized sled is fixed to the horizontally movable motorized sled.

In an alternative embodiment, the vertically movable motorized sled is fixed to the frame and the horizontally movable motorized sled is fixed to the vertically movable motorized sled. In any case, thanks to the motorized sleds, the at least one inkjet printhead is movable both vertically and horizontally towards the immovable frame of the service station with mounted thereon at least one capping element for capping the at least one inkjet printhead (during the vertical movement of the printhead) and at least one wiping element for wiping the at least one inkjet printhead (during the horizontal movement of the printhead back and forth).

According to a further aspect of the invention, the at least one capping element comprises a sealing ring extending around an outer profile of the at least one capping element. A height of the at least one wiping element is greater than a height of the sealing ring of the at least one capping element.

According to a further aspect of the invention, the at least one capping element further comprises a hollow basin with a sloped bottom and a pipe connecting the at least one capping element with the waste ink tank.

According to a further aspect of the invention, the at least one capping element, the sealing ring and the pipe can be made as an integral part by molding, preferably by double-shot molding.

According to a further aspect of the invention, the at least one wiping element is received into a cavity realized in a support of the at least one inkjet printhead.

According to a further aspect of the invention, the modular service station further comprises a removable sealing system directly mounted onto the wiping element and/or capping element of the modular service station.

According to another aspect of the invention, a method of servicing an inkjet printhead of an inkjet printing system, comprising the steps of:

moving the inkjet printhead horizontally from the printing position towards the service station, enabling a wiping process by bringing in contact a surface of the inkjet printhead and at least one wiping element during the horizontal movement of the printhead back and forth, enabling capping, unclogging or purging processes in respect to the inkjet printhead by vertical movement of the inkjet printhead.

According to a further aspect of the invention, the method further comprises conveying the ink ejected by the nozzles during the capping, unclogging or purging processes to a waste ink tank in hermetic communication with at least one capping element.

According to a further aspect of the invention, the method further comprises lowering the inkjet printhead along the vertical axis during the capping process and engaging at least one capping element.

The present invention will be described more fully hereinafter with reference to the accompanying drawings in which same numerals represent same elements throughout the different figures, and in which prominent aspects and features of the invention are illustrated.

DETAILED DESCRIPTION

A thermal ink jet printhead generally comprises an array of nozzles, suitably activated for ejecting ink droplets onto the medium, performing in this way the printing operation. The printhead and the printing medium are in relative movement with respect to each other and the nozzle array extension in a direction orthogonal to the direction of relative movement is called the "printing swath".

Figure 1:
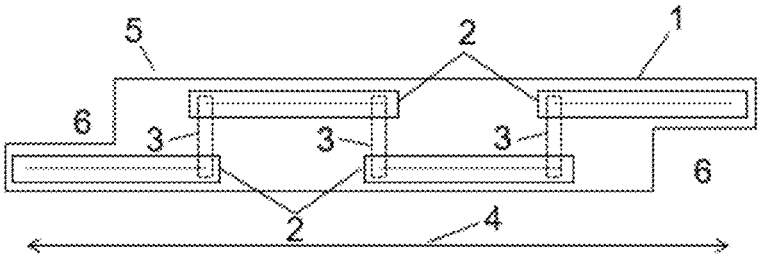
FIG. 1 is a schematic illustration of a Multi-Chip Module (MCM) suitably assembled onto a substrate.

When the printhead has a single silicon chip, the swath is the length between the first and the last nozzle in the array. To increase the swath length, an advantageous solution is to align a plurality of silicon chips onto a single substrate, forming a Multi-Chip Module (MCM) to obtain an effective larger printing swath. An example of MCM composed by four silicon chips suitably assembled onto a substrate is shown in FIG. 1. The substrate 1 houses the silicon chips 2, suitably aligned on the substrate 1. The contiguous chips 2 are transversally displaced and positioned onto the substrate 1, so as to have some overlap of the extreme nozzles of adjacent printheads. This feature guarantees that the whole swath length is covered by the nozzles, without leaving detrimental gaps. The mutually exclusive activation of the overlapped nozzles 3 is managed by the printhead controller, which is electrically connected to the MCM 5. The substrate 1 can be shaped in such a way that two recessed regions 6 are left at the opposite corners: this feature allows the aligned positioning of a plurality of modules along the horizontal direction 4, to increase even more the swath length.

Figure 2:
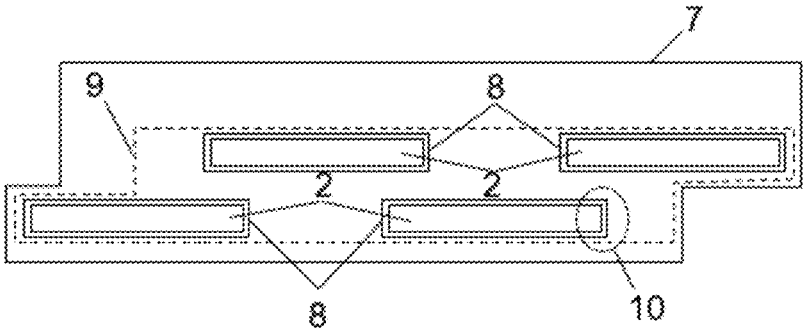
FIG. 2 illustrates a plurality of aligned MCM modules positioned onto a suitable support.

In one embodiment, a plurality of aligned MCM modules is positioned onto a suitable support, as described in FIG. 2. Each module is covered by a Printed Wiring Board (PWB) provided with openings, so as to leave the surface of the chips exposed, without any obstruction. The PWB 7 is provided with bonding pads placed near the edge of the openings 8, facing the corresponding bonding pads onto the silicon chips 2. The PWB 7 is attached to the underlying MCM through a double side adhesive tape or through some adhesive glue suitably dispensed.

In FIG. 2 the outer profile of the underlying MCM substrate is indicated by the dotted line 9. The electrical connections between the PWB and the silicon chips can be done through the well-known Wire Bonding process, even if other methods are possible. The PWB houses a further electrical connection with an external controller (not shown).

Figure 3A:
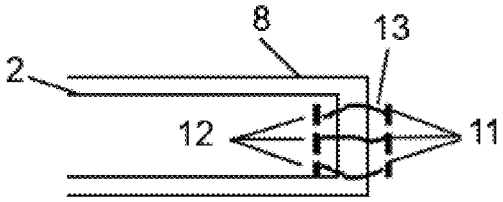
FIG. 3*a-b* provides a more detailed illustration of the region enclosed in the dotted circle 10 of FIG. 2, in both a top view (FIG. 3*a*) and a cross section view (FIG. 3*b*).
Figure 3B:
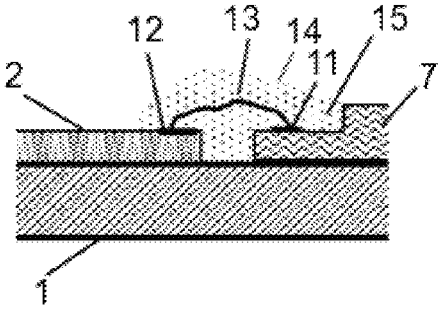

The region enclosed in the dotted circle 10 in FIG. 2 is zoomed-in in FIG. 3, in both top view (FIG. 3*a*) and cross section view (FIG. 3*b*).

Referring to FIG. 3*a*, the bonding pads 11, near to the PWB opening 8, are electrically connected to the corresponding bonding pads 12 onto the silicon chip 2 through the conducting wires 13, which are realized through the Wire Bonding process.

FIG. 3*b* depicts a further segment of sealing glue 14, applied after the Wire Bonding in the cavity between the chip 2 and the PWB 7; the sealing glue incorporates the pads 11 and 12, as well as the connecting wire 13, to give both electrical and mechanical protection.

In FIG. 3*b* the bonding pads 11 are placed in a suitable recessed region 15, so as to keep the wire 13 and the sealing glue 14 at a low elevation level, although in an alternative embodiment (not shown in the FIG. 3*b*) the bonding pads 11 can be placed on the top of the PWB.

Figure 4:
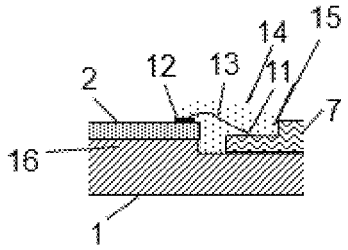
FIG. 4 provides a more detailed illustration of the alternative embodiment of the region enclosed in the dotted circle 10 of FIG. 2, with a protruding rim in the graphite substrate.

In another embodiment, shown in FIG. 4, the graphite substrate 1 is shaped in such a way that a protruding rim 16 is generated in the region where the silicon chip has to be placed, so as to raise the top surface of the latter to facilitate the surface cleaning.

Figure 5A:
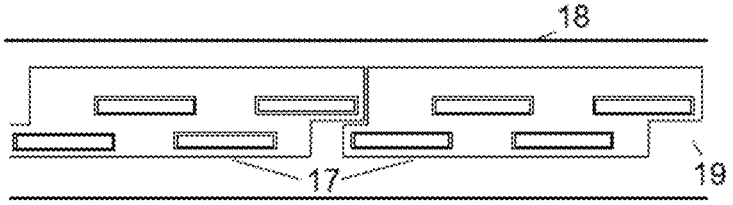
FIG. 5*a-b* provides a schematic illustration of the arrangement of the plurality of the MCM assemblies arranged onto the support (FIG. 5*a*) and a duplicated arrangement of the plurality of the MCM assemblies (FIG. 5*b*).

Referring to FIG. 5, a single MCM assembly or a plurality of mutually aligned MCM assemblies 17 can be fixed onto a suitable support 18 to provide a long swath printhead. For clarity reasons, FIG. 5*a* depicts a portion with only two MCM assemblies. The support 18 houses also the fluidic connections for feeding the plurality of printheads with ink and the electrical connections towards the external controller. The plurality of the MCM assemblies 17 arranged onto the support 18 form the printhead 19, which in a way can be considered as a long-swath printhead and assumed as a single printing device, which spans the width of the printing media.

Figure 5B:
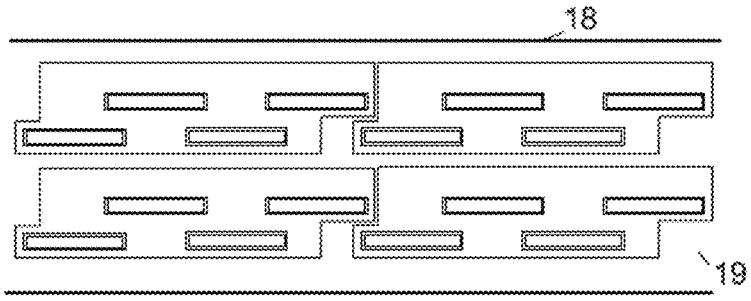

In a further embodiment, the arrangement shown in FIG. 5*a* can be duplicated, adding transversally similar suitably aligned MCM assemblies. This is illustrated in FIG. 5*b*. This embodiment is particularly effective when a higher printing speed is pursued.

Figure 6A:
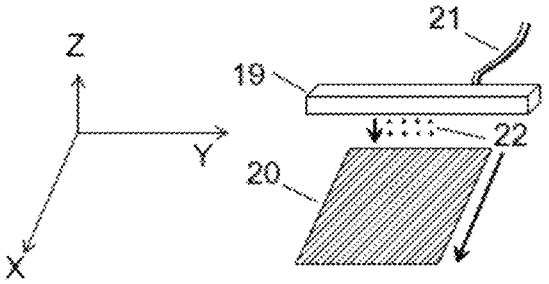
FIG. 6*a-b* illustrates basic parts of the printing equipment in both a perspective view (FIG. 6*a*) and a lateral view (FIG. 6*b*).
Figure 6B:
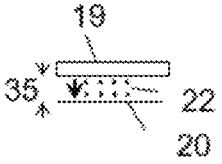

FIG. 6 illustrates basic parts of the printing equipment. The printhead 19 is placed horizontally, with the nozzles facing down, towards the printing medium 20, which moves along the direction of the arrow transversally with respect to the longitudinal axis of the printhead, which during the printing remains still with respect to the equipment framework.

However, the printhead can be precisely moved in a controlled way along a vertical axis. In fact, the printhead is firmly fixed to a motorized sled, which allows the vertical movement along the Z axis, which is perpendicular to both the longitudinal printhead axis Y and the medium sliding axis X, both of which extend in the horizontal direction, as described in FIG. 6*a*. The fluidic connections as well as electrical connections 21 allow a certain degree of movement of the printhead, since they consist of flexible elements, like pipes or cables. The drops 22 are ejected vertically, along the arrow, towards the medium 20. Each drop produces a dot on the medium. The vertical adjustment of the distance between the front surface of the printhead 19 and the printing medium 20 by means of the motorized sled (not shown) allows the optimization of the gap height 35, aiming at the best printing quality, as illustrated in the lateral view of FIG. 6*b*.

Elimination of the clogged ink from the nozzles can be effectively done activating repeatedly the nozzles so as to induce the clog removal by a thermo-mechanical action. The operation is even more effective if the wiping of the nozzle surface with a soft blade is performed. Some ink droplets unavoidably present in proximity of the nozzles make the blade wet, so that a thin liquid film is spread across the nozzle surface when the blade moves across the front of the printhead: this makes easier the elimination of the clog from the nozzles, probably due to the capillary effect, recovering the functionality of the device.

In other circumstances, the purging of the nozzles could be necessary to eliminate some unexpected issue due to the possible obstruction of the fluidic circuit: for example, when the empty printing device is filled with ink the first time or after some technical intervention. Normally, the ink delivery system of the printing equipment is designed in such a way that the ink filling takes place regularly, without any problem, but the possibility to purge the fluidic circuit with the repeated activation of the nozzles is an additional resource to fix issues occurred by chance.

The repeated activation of the nozzles, either to remove the clogs or to eliminate possible obstructions in the fluidic circuit, may cause the ejection of some ink, which produces unwanted dots or stains onto the printing medium, becoming a significant disadvantage of the existing solutions.

According to the present invention, the above-mentioned problem is solved by distancing the printhead away from the medium, moving it to a suitable service station, able to collect the ejected ink. This operation can be accomplished by adding another motorized sled, which moves the printhead horizontally, for example along the Y axis, away from the medium 20 towards the servicing station, as illustrated in FIG. 7.

Figure 7:
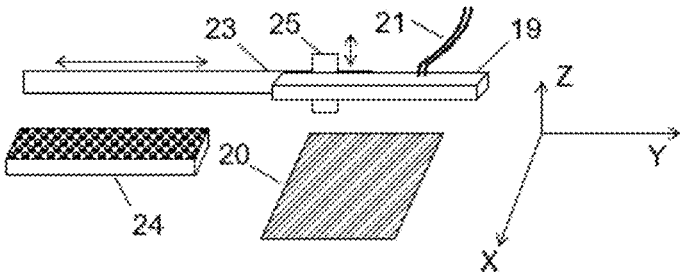
FIG. 7 illustrates the printing equipment with a horizontal motorized sled fixed to the equipment framework and a vertical motorized sled fixed onto the horizontal sled.

Referring to FIG. 7, the horizontal motorized sled 23 is fixed to the equipment framework and moves back and forth along the Y axis. Advancing forwards, in the positive Y direction, the horizontal motorized sled 23 moves the printhead 19 to the printing position, above the medium 20, whilst backwards it carries the printhead 19 in the negative direction, above the service station 24.

The vertical motorized sled 25 is in turn fixed onto the horizontal motorized sled 23 and moves up and down along the Z axis; when the printhead 19 is in the printing position, above the printing medium 20. The vertical motorized sled 25 allows the accurate adjustment of the distance between the front surface of the printhead and the medium, for an optimum printing quality.

In alternative embodiment (not shown), the vertical motorized sled 25 is fixed to the equipment framework, whilst the horizontal motorized sled 23 is in turn fixed onto the vertical one, without going apart from the operational modality described above.

As mentioned above, when the nozzles do not eject the ink for a while, the evaporation of the liquid from the nozzle surface can cause the clogging of the nozzles. This risk of clogging is particularly remarkable when the printhead remains idle for a long period, e.g. overnight or when the printing operation must be interrupted for a long time. A practical solution is a capping element to shut the surface of all the nozzles of each Multi-Chip Module in a closed, small volume, using a suitable capping element, as illustrated in FIG. 8.

Figure 8A:
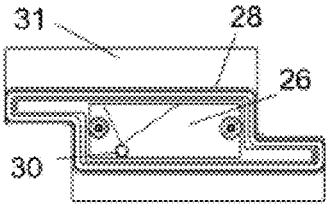
FIG. 8*a-c* illustrates a capping element provided to shut the surface of all the nozzles of each Multi-Chip Module, in a top view (FIG. 8*a*), a perspective view (FIG. 8*b*) and a schematic view (FIG. 8*c*).
Figure 8B:
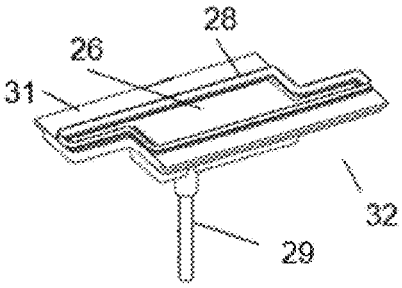
Figure 8C:
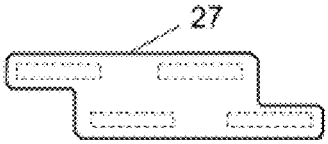

In particular, as mentioned in FIG. 8*a* and FIG. 8*b*, the capping element consists basically of a part 31, provided with a hollow basin 26 and houses a sealing ring 28, which extends around the whole outer profile tracing its shape, so as to keep all the nozzles hermetically closed within a small volume when the capping element is pressed against the front surface of the MCM assembly. The outer profile 27 is well seen on FIG. 8*c* and surrounds all the nozzles of the chips present in a MCM, which occupy the region indicated by the dotted profile.

When the printhead consists of a plurality of MCM assemblies, each one has to be provided with a suitable capping element. The ink evaporation from the nozzle surface makes the solvent vapor pressure increase within the closed volume. Since no vapor leakage can take place, because of the hermetic sealing ring 28, the internal vapor pressure reaches a value close to the saturation level, so that a kind of dynamical equilibrium occurs inside the close environment, preventing any further net evaporation from the nozzle surface. Therefore, the printhead can remain idle for a long period, without undergoing any appreciable clogging of the nozzles.

The capping element can be housed in the service station. In this embodiment, the hollow basin 26 can be shaped with a sloped bottom, so as to collect the ink ejected by the nozzles during the unclogging or the purging operation, conveying it to a waste collecting tank (not shown) through the pipe 29. The upper end of the pipe 29 is in communication with the sloped bottom of the basin 26 through the drain hole 30. All the parts that put the pipe 29 in communication with the tank, like hoses, caps or else, can be hermetically fastened so that, in the operational configuration, the inner space from the tank and the pipe 29 has no communication with the external environment.

After moving the printhead 19 above the service station 24 for servicing, the motorized slide 25 can be used either to move vertically the printhead towards the capping element or to lift the printhead up to a certain distance from the capping element, depending on the actual need. If only unclogging or purging processes are performed, the printhead should be kept close to the capping element but not in contact with it, leaving a certain gap in between, to prevent the ejected droplets from bouncing back on the front surface of the printhead.

On the other hand, if the capping operation must be performed to prevent the clogging of the nozzles, the printhead can be brought in contact with the capping element, to seal hermetically the nozzles of the printhead. The waste collecting tank can be partially filled with ink. In the operational configuration, as mentioned above, it is in fluidic communication only with the capping element. Therefore, in the capping phase, when the capping element is in sealing contact with the printhead front surface, the internal volume formed by the hollow basin of the capping element, by the waste collecting tank and by the communication pipe in between remains hermetically separated from the external environment, without any leakage, allowing the solvent vapor pressure to establish in the closed room, preventing any further clogging of the nozzles.

The capping element 32 comprising the hollow basin 26, depicted in FIG. 8, can be obtained by molding, while the sealing ring 27, as well as the pipe 30, can be assembled later.

In an alternative embodiment, two of the parts or, preferably, all of them can be produced with a more sophisticated process, like the double-shot molding. In particular, the piece constituting the pipe 30 can be initially inserted in a suitable insertion port of the mold and a thermoplastic material can be injected, as a first shot, into the mound to form the part 31, wherein the hollow basin 26 lies. The thermoplastic material surrounds the inserted extremity of the pipe, fastening it hermetically in an integral body. Subsequently, after rotating the mold according with the art, a soft, rubber-like material is injected, in a second shot, to realize the sealing portion of the capping element.

The double-shot molding process optimizes the junction of hard and soft materials to create powerful bond at the interface. Moreover, the capping element 32, including the pipe 30 and the sealing ring 28, can be obtained as an integral body without needing the further assembling of different parts, that may cause the risk of residual pores at the interface.

Figure 9:
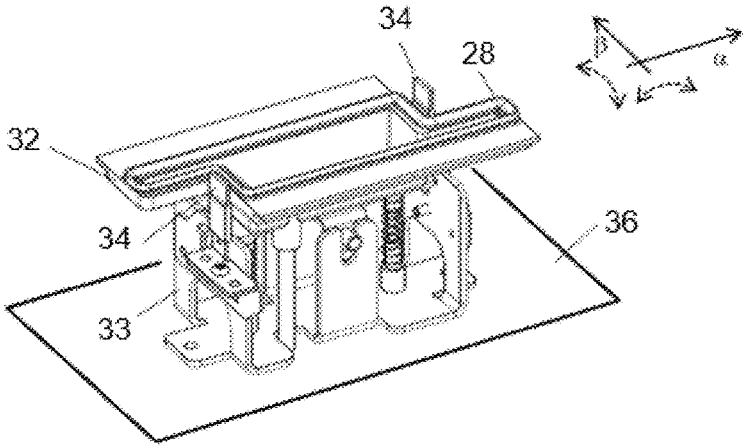
FIG. 9 illustrates arrangement of the capping element in a suitable frame.

The capping element 32 must be mounted in a suitable frame 33, in order to seal effectively the front surface of the printhead where the nozzles are placed, as illustrated further in FIG. 9. The frame 33 also houses the wiping blades 34.

The capping element 32 is movable with respect to the frame to some extent, but not completely. There are some constraints in the frame structure, which force the capping element to stay within the frame perimeter, but allow it to lean slightly about the axis $\alpha$ and $\beta$, and to move slightly along the vertical direction, enabling an accurate matching with the front surface of the printhead. The frame 33 is fixed to a base plate 36, which is parallel to the medium plane and is, in turn, firmly attached to the equipment framework.

Figure 10A:
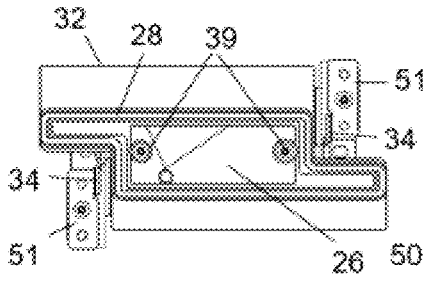
FIG. 10*a-b* illustrates a more detailed illustration of the capping element of FIG. 9, in both a top view (FIG. 10*a*) and a lateral view (FIG. 10*b*).
Figure 10B:
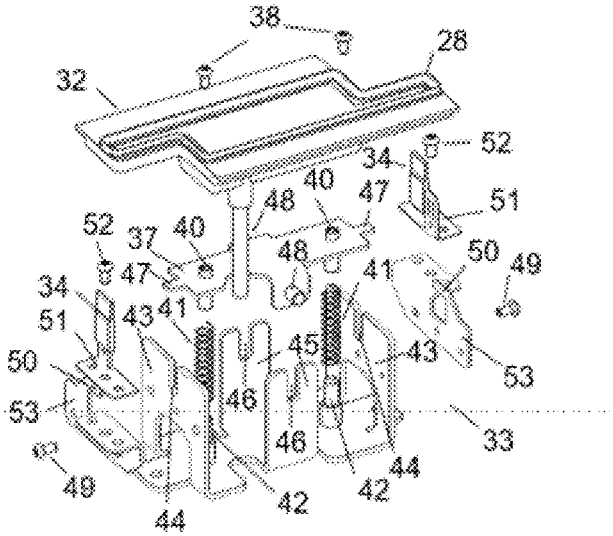

Referring to FIG. 10, in an embodiment, the frame 33 is structured as illustrated in FIG. 10*a* and FIG. 10*b* (exploded view). The capping element 32 is fixed onto the plate 37 by the screws 38, which pass through the holes 39 at the bottom of the hollow basin 26. The screws 38 are tightened into the bushes 40, which are firmly inserted into the plate 37. At the lower plate side, the bushes are prolonged in form of cylinder. In fact, they engage the springs 41, passing through the coils. At the lower side the springs 41 are engaged by other linchpins 42 connected to the base of the frame 33. Therefore, the capping element 32, tightened to the plate 37, turns out to be biased upwards by the coil springs 41.

The frame 33 is provided with two longitudinal flanks 43, which are vertical plates wherein the vertical slots 44 have been realized. Moreover, two other transverse flanks 45 are present, orthogonal to the longitudinal flanks 43, where two other vertical slots 46 are made. The vertical slots 44 and 46 act like runners for the movement of the plate 37. In fact, the plate 37 comprises two tabs 47 along the longitudinal direction and two pins 48 along the transverse direction. Tabs and pins can slide along the slots, allowing the plate to move vertically as well as to rotate about both the longitudinal and transverse axis $\alpha$ and $\beta$ indicated in FIG. 9, without exiting from the frame perimeter. The vertical slots 44 are closed at the top by the stopping plates 53, which are fastened to the flanks 43 through the screws 49. In the stopping plate 53, the fingers 50 act as an abutment for the tabs 47, stopping the upwards motion of the plate, biased by the coil springs. To complete the overall structure, two additional parts 51 are added, to support the two wiping blades 34. The support parts 51 are tightened to the stopping plates 53 by the screws 52 and the wiping blades are in turn inserted into the suitable portion of the supports 51.

Figure 11:
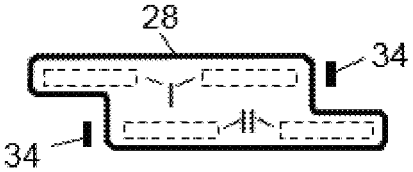
FIG. 11 illustrates a top view of the capping element and a position of two wiping blades with respect to a sealing ring of the capping device.

The position of the two wiping blades 34 with respect to the sealing ring 28 and to the four chips (two upper chips labelled with "I" and two lower chips labelled with "II") of the respective MCM, which are in turn indicated by the dotted profile, is illustrated in FIG. 11. The wiping blades 34 are mounted so as to exceed the height of the sealing ring 28, as is also clearly visible in FIG. 9. This feature allows the wiping blades 34 to get in touch with the front surface of the printhead, before the latter engages the sealing ring 28.

The wiping process is performed moving back and forth horizontally the printhead along the longitudinal Y axis. Since the printhead 19 consists of a plurality of MCM assemblies, modularly arranged onto the support 18 to provide a unique printing swath 4, the wiping and capping elements can be also conceived as a modular assembly of individual capping and wiping elements, arranged side-by-side as shown in FIG. 12, where only two elements are present, for the sake of clarity.

Figure 12:
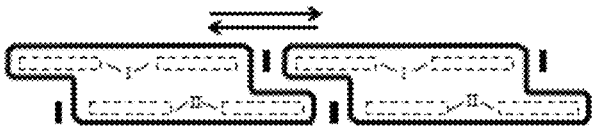
FIG. 12 illustrates a top view of a modular assembly of individual capping elements and wiping blades, arranged side-by-side.

Referring again to FIG. 11, the upper-right wiping blade serves the chips pair "I" of its own module, whilst the chip pair "II" is served by the lower-left wiping blade of the contiguous MCM, visible in FIG. 12.

Returning to FIG. 12, if the printhead, to perform the cleaning of the surface, is moved at first to the right and then it is returned to the original position, whilst the capping element with the wiping blades remain still underneath, the upper chips are wiped by the wiping blade mounted on its own capping frame, whilst the lower chips rely on the wiping blade mounted on the adjacent module. The contrary happens if during the cleaning process the printhead is moved to the left.

During the capping phase, the printhead is lowered along the vertical axis by means of the vertical motorized sled, so as to engage with the capping element. With reference to FIG. 9 and FIG. 10, just before the engagement the capping element is biased upwards by the coil springs 41, but it is stopped by the fingers 50 of the plates 53. After the engagement, the downward movement of the printhead detaches the tabs 47 of the plate 37 from the stopping fingers 50, pulling downward the capping element, which is in turn counter-biased by the spring. The plate detachment allows some movement about the axis $\alpha$ and $\beta$, accomplishing the accurate matching of the sealing ring 28 with the front surface of the printhead. The movement of the printhead is stopped after a predetermined travel, to ensure the effective sealing of the nozzles.

Figure 13:
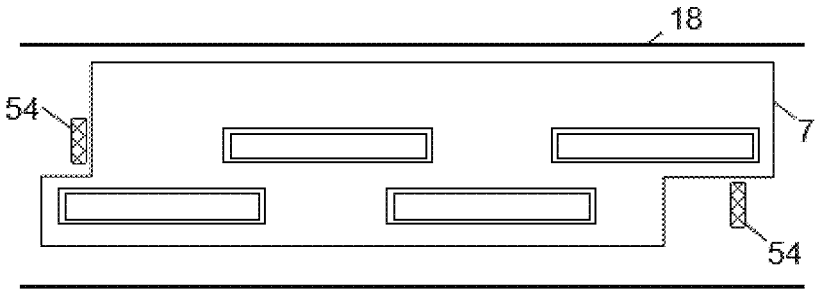
FIG. 13 illustrates the MCM assembly on the support with pockets for housing wiping blades.

Since the wiping blades 34 exceed the height of the sealing ring 28, during the engagement they may get in contact with the front surface of the printhead before the sealing ring. To prevent any obstruction which would hamper the correct engagement or cause the damage of the wiping blades, the wiping blades are housed into suitable pockets 54, which are actually cavities realized in the MCM assembly support 18, beside each MCM assembly 7, as shown in FIG. 13. The depth of the pockets is such that, in the capping configuration, the wiping blades can be housed without bending.

Figure 14:
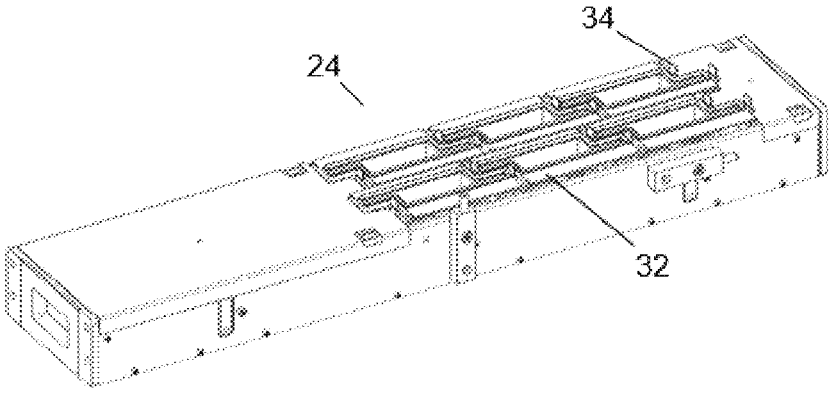
FIG. 14 illustrates the perspective view of the whole modular service station according to the invention.

FIG. 14 illustrates the whole modular service station 24 comprising the arrangement of a plurality of frames 33, onto which the capping elements 32 and the wiping blades 32 are mounted. In an aspect of the invention, said configuration is suitable for the printhead embodiment with the duplicated arrangement of MCM assemblies, illustrated in FIG. 5*b*.

Figure 15A:
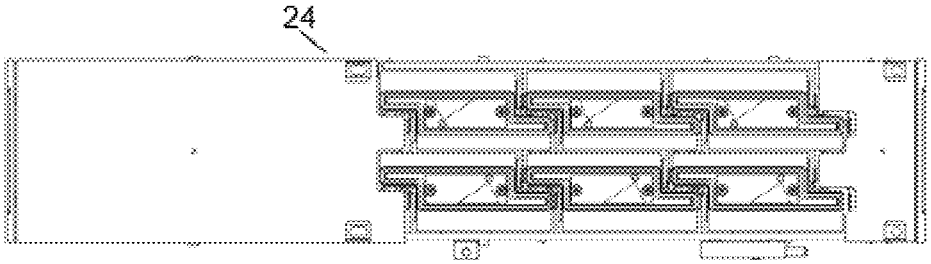
FIG. 15*a-b* illustrates the top view (FIG. 15*a*) and the lateral cross section view (FIG. 15*b*) of the whole modular service station according to the invention.
Figure 15B:
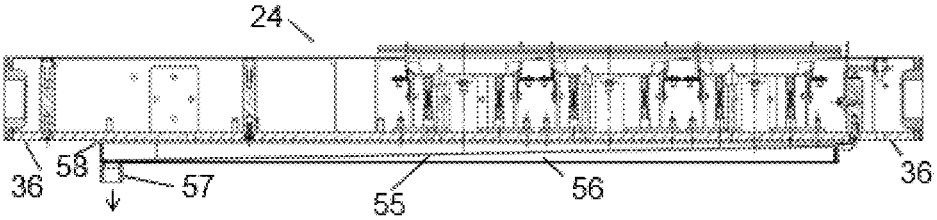

FIG. 15 further illustrates the whole modular service station 24, with the top view (FIG. 15*a*) and in lateral cross section view (FIG. 15*b*), respectively.

As illustrated in FIG. 15*b*, in the lower portion of the service station 24 there is a waste collecting gutter 56. It constitutes a long, sloped collector, fixed below the base plate 36, where the lower ends of all drain pipes 29 are merged. The ink dropping from the pipe goes into the sloped gutter, having an inclined floor 55, until it reaches the outlet connector 57, which, in turn, is brought downstream in hermetic communication with the waste ink tank (not shown), through a pipe or some other kind of duct.

The base plate 36 comprises suitable holes, through which the pipe 29 passes into the gutter 56, without any rubbing with the base plate. The tight insertion of the pipe 29 into the gutter 56, so as to prevent any liquid or vapor leakage during the capping phase, is accomplished through the intermediate layer 58 interposed between the base plate 36 and the gutter 56. In fact, the pipe 29, which is a part of the capping element 32, can move in the capping operation, due to the engagement with the front surface of the printhead and the relative pressure applied during the vertical movement of the printhead. The intermediate layer 58 acts as a gasket, allowing the hermetic seal between the movable pipe and the gutter, as well as the hermetic fastening of the gutter 56 to the base plate 36 above it.

Figure 16A:
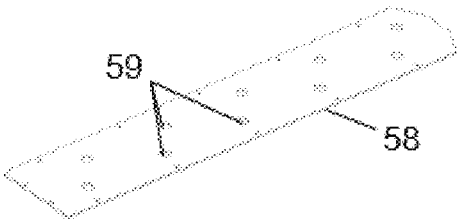
FIG. 16*a-b* schematically illustrates an intermediate layer, which enables to prevent any liquid or vapor leakage during the capping phase (FIG. 16*a*) and the lateral cross section view of the arrangement of the intermediate layer (FIG. 16*b*).
Figure 16B:
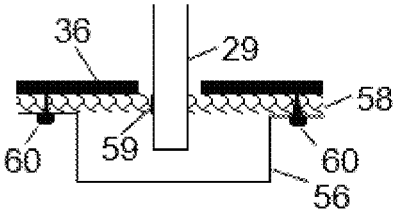

The intermediate layer 58 is illustrated in FIG. 16. In the intermediate layer 58 comprises a plurality of holes 59, whose diameter is slightly lesser than the external diameter of the pipe 29, to prevent any clearance after the insertion of the pipe. The position of the holes 59 in the intermediate layer 58 corresponds to the position of the pipes 29 in the service station, as illustrated in FIG. 16*a*. Each pipe 29 passes through the corresponding hole 59 of the intermediate layer 58, going into the gutter 56. Since the intermediate layer is made of a suitably soft material, it allows the pipe to slip back and forth through the hole, guaranteeing the hermetic sealing. The material of the intermediate layer 58 must be chemically compatible and resistant to the ink solvent. A suitable material can be EPDM foam with closed cells, whilst other kind of material could be also adopted. As shown in FIG. 16*b*, the intermediate layer 58 is fastened with the screws 60 to the base plate 29 and the interposed intermediate layer 58 can also ensure the hermetic fastening between the two parts.

In practice, during the ink filling of a printhead, an operation where the nozzles are hermetically closed for a certain time is required. A way to accomplish this requirement is to apply a shutter plate to the surface of the plurality of printheads acting a suitable pressure, so as to obstruct hermetically all the nozzles on the surface, thus preventing any fluidic communication with the outer environment or leakage. The plate used to seal the nozzles should accurately fit the printhead surface. The shutter plate material should be mildly soft, in order to adapt to the surface morphology without damaging it. Moreover, also the chemical compatibility and resistance with respect to the ink components is required. EPDM foam is a suitable example for the application. But the material should have a lower cell size compared with the interposed intermediate layer 58 described above, to be able to seal effectively the nozzles due to a slightly higher deformability.

Since the printhead surface is rather extended, it is advantageous to address individually the sealing of each MCM assembly or, more preferably, the sealing of each silicon chip. Therefore, the pressure necessary to get the hermetic contact between the plate and the nozzles needs to be applied with a margin of independence in the different parts of the printhead surface.

An effective implementation of the sealing system, which can be employed according to the invention, relies on the arrangement of independent frames, each one housing a plate upwardly biased by spring coils. The plate is able to tilt slightly about the equilibrium position, once the engagement with the printhead surface and the downward movement of the printhead has detached the plate from its stopping abutment, according to a concept which is similar to the described capping system, even if the actual implementation is quite different.

Figure 17:
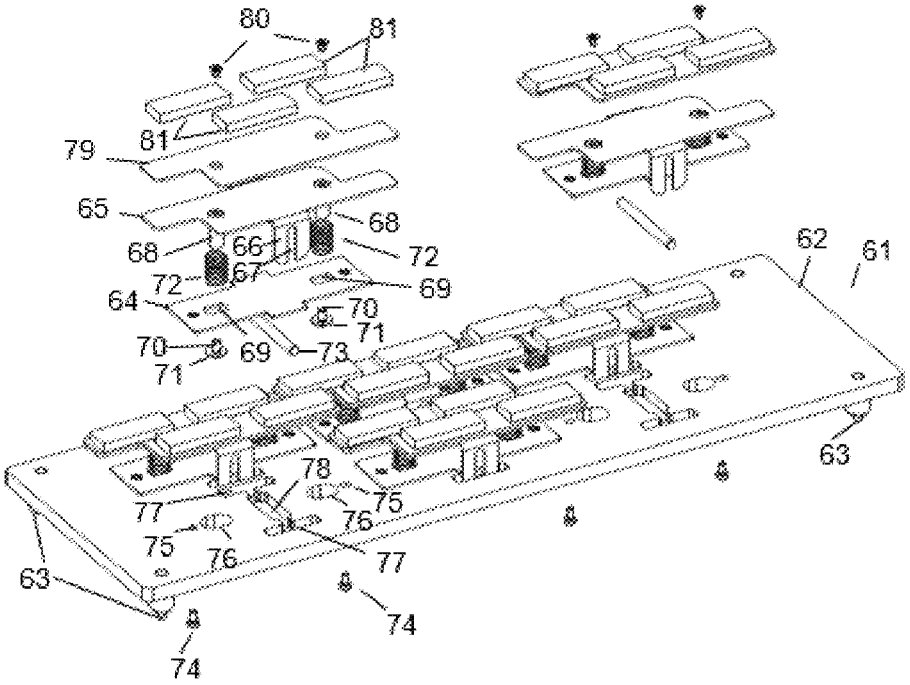
FIG. 17 schematically illustrates the improved sealing system employed according to the invention.

The sealing system 61, illustrated in the exploded view of FIG. 17, comprises a support base 62 provided with fiducial pins 63 for mounting onto the servicing station 24. A plurality of frames 64 are positioned onto the support base 62, according to the layout of the MCM assemblies in the printhead. An upper plate 65, having two symmetric lateral warped flanks 66, provided in turn with vertical slots 67, can tilt above the frame 24, about the equilibrium position. In fact, two vertical cylinders 68 are fixed below the plate 65, passing through the suitable holes 69 in the frame 64 and being fixed below the frame 64 by the screw 70, with the interposed spacing washer 71, whose diameter is larger than the size of the holes 69.

The cylinders 68 pass through two coil springs 72, which are engaged and guided by them. The coil spring diameter is larger than the size of the holes 69 and therefore the coil springs lie onto the upper side of the frame 64, whilst the cylinders 68 can pass through freely. Therefore, the plate 65 turns out to be upwardly biased by the coil springs 72, until the spacing washer 71 hits against the lower face of the frame 64, which acts as a stopper. A pressure applied downwards to the upper plate 65 can cause the detachment of the spacing washer 71 from the lower face of the frame 64 and the plate 65 can move down, counter-biased by the coil springs 72.

The support 62 is the base, onto which the frame 64 is fixed by the screws 74, which pass through the holes 75. The holes 76 on the support correspond to the holes 69 of the frame 64. The holes 69 are large enough so as not to cause any obstruction to the movement of the cylinders 68 with the fastened screw 70 and the spacer washer 71. Two additional slots 77 are made in the support 62 to allow the vertical flanks 66 of the plate 65 to pass through freely in their movement. Finally, a suitable recess 78 houses the rod 73, which stays within the slots 67 of the flanks 66, acting as a guiding member. After fastening the frame 64 to the support 62 through the screws 74, the guiding rod 73 remains firmly pinched in between.

Figure 18A:
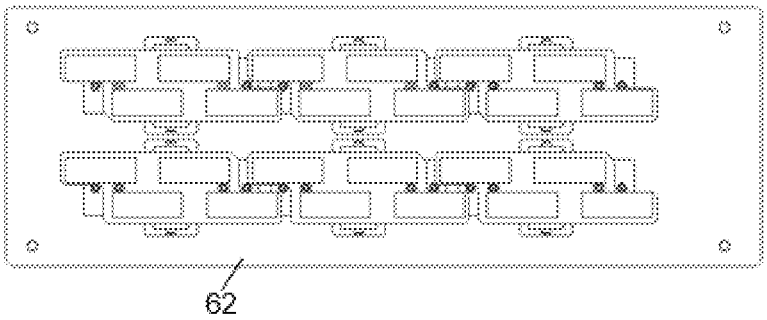
FIG. 18*a-b* illustrates the top view (FIG. 18*a*) and the perspective view (FIG. 18*b*) of the assembled sealing system.
Figure 18B:
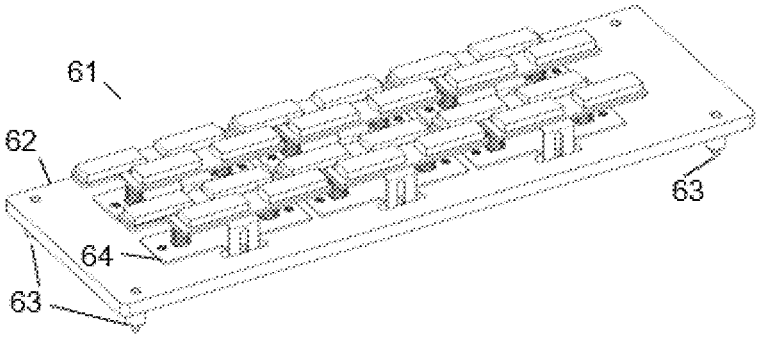

An additional plate 79 can be fastened onto the upper plate 65 through the screws 80. It comprises on its surface, the EPDM shutter plates 81, corresponding to the number of silicon chips in a single MCM assembly. They are attached to the plate 79 with an accurate alignment with respect to the silicon chips in the MCM assembly. Preferably, the longitudinal size of a sealing plate 81 is lesser than the length of a silicon chip, to prevent any mechanical obstruction from the sealing glue 14 which encloses the conductive wires 13, as described in FIG. 3 and FIG. 4. The length of the sealing plate 81 is adequate to cover the surface occupied by all the nozzles in the silicon chip, without getting in contact with the chip extremities, where the bonding pads are placed. The assembly of the sealing plates 81 onto the plate 79 allows the easy replacement of the item. The top view and the overall view of the assembled sealing system 61 is depicted in FIGS. 18*a* and 18*b*, respectively.

The advantage of the described solution is that it is not necessary to remove the capping element 24 to fit instead the sealing system 61, because the sealing system 61 can be mounted on top using the pins 63, which are inserted in suitable holes of the capping system. The sealing system 61 can be easily inserted and removed, according to the requirement. It needs only that the motorized sled which moves the printhead vertically along the axis Z has a sufficient length to house both the capping element and the sealing system, without any interference when the printhead is in its highest position.

The procedure to seal hermetically the nozzles with the sealing system 61 is similar to the capping procedure. If the vertical travel of the printhead is large enough, the sealing system 61 can be directly mounted onto the wiping elements and a capping element of the service station 24, without the need to remove the same. Further, lowering the printhead, the front surface of the printhead engages the sealing plates 81. The downward movement causes the detachment of the spacing washer 71 from the stopping surface of the frame 64. This enables the tilting of the plate 79, which houses the sealing plates 81, about two axis, accomplishing the optimum contact with the printhead surface, which provides the sealing of the nozzles.

The proposed solution for the a modular service station for servicing inkjet printhead of an inkjet printing system according to the invention turns out to be simple and effective.

Compared with other known service stations, the present invention provides a simple, compact, efficient, customizable and cost-effective modular service station, which is capable to efficiently perform wiping, purging and capping of the printhead.

In this regard, the invention enables to avoid unwanted dots or stains onto the printing medium during the servicing operation, thanks to the double motorized sleds, moving along orthogonal directions: horizontally, to allow the transport of the printhead away from the printing region to the service station as well as the wiping movement, and vertically, to adjust the distance with the medium in the printing region, to adjust the distance with the service station for the nozzle purging, to engage and push down the cap for the capping operation, to leave the necessary distance to fit in the additional nozzle sealing item; to engage and push down the sealing item to seal the nozzles.

The invention enables the hermetic sealing of the printhead surface thanks to the advanced double-shot molding method for the capping element.

The invention further provides a safe, simple and integrated system for both purging and capping thanks to the waste ink tank being in hermetic communication with the capping element, which prevents any leakage of liquid or vapor when the printhead is capped.

The above disclosed subject matter is to be considered illustrative, and not restrictive, and serves to provide a better understanding of the inventions defined by the independent claims.

The invention claimed is:

1. A modular service system for servicing an inkjet printhead of an inkjet printing system, the inkjet printhead comprising at least two Multi-Chip Module (MCM) assemblies arranged on a support, the service system comprising:

at least two frames with mounted on each of the at least two frames a capping element for capping a corresponding one of the at least two MCM assemblies of the inkjet printhead, and at least two wiping elements for wiping the inkjet printhead, a means for horizontal movement of the inkjet printhead between a printing position and a servicing position, a means for vertical movement of the inkjet printhead, the means for vertical movement configured to enable capping, unclogging or purging processes in respect to the inkjet printhead, and a waste ink tank in hermetic communication with each of the capping elements, wherein the means for horizontal movement is configured to enable a wiping process by bringing in contact a surface of the inkjet printhead and the wiping elements during the horizontal movement of the inkjet printhead back and forth, wherein for each of the at least two frames, one of the at least two wiping elements is arranged on one end of the frame, which corresponds to one end of one row of chips of a corresponding one of the at least two MCM assemblies, and the other one of the at least two wiping elements is arranged on an opposite end of the frame, which corresponds to one end of an adjacent row of chips of the corresponding one of the at least two MCM assemblies, so that when the one row of chips of one of the at least two MCM assemblies is wiped by one of the at least two wiping elements mounted on a corresponding frame of the at least two frames, the adjacent row of chips of said one of the at least two MCM assemblies is wiped by one of the at least two wiping elements mounted on an adjacent frame of the at least two frames.

2. The modular service system according to claim 1, wherein the at least two wiping elements are wiping blades.

3. The modular service system according to claim 1, wherein the means for horizontal movement of the inkjet printhead and the means for vertical movement of the inkjet printhead are a horizontally movable motorized sled and a vertically movable motorized sled, respectively.

4. The modular service system according to claim 3, wherein the service system further comprises an equipment framework, and the horizontally movable motorized sled is fixed to the equipment framework and the vertically movable motorized sled is fixed on the horizontally movable motorized sled.

5. The modular service system according to claim 3, wherein the service system further comprises an equipment framework, and the vertically movable motorized sled is fixed to the equipment framework and the horizontally movable motorized sled is fixed on the vertically movable motorized sled.

6. The modular service system according to claim 1, wherein the capping element comprises a sealing ring extending around an outer profile of the capping element.

7. The modular service system according to claim 6, wherein a height of the at least two wiping elements is greater than a height of the sealing ring of the capping element.

8. The modular service system according to claim 1, wherein the capping element further comprises a hollow basin with a sloped bottom and a pipe connecting the capping element with the waste ink tank.

9. The modular service system according to claim 8, wherein the capping element, the sealing ring and the pipe are made as an integral part by molding.

10. The modular service system according to claim 8, wherein the capping element, the sealing ring and the pipe are made as an integral part by double-shot molding.

11. The modular service system according to claim 1, wherein the at least two wiping elements of each of the at least two frames are configured to be housed, in a capping configuration, into suitable cavities realized in the support of the inkjet printhead.

12. The modular service system according to claim 1, further comprising a removable sealing system directly mounted onto the wiping elements and/or capping elements of the modular service system.

13. A method of servicing an inkjet printhead of an inkjet printing system, the inkjet printhead comprising at least two Multi-Chip Module (MCM) assemblies arranged on a support, the method comprising the steps of:

moving the inkjet printhead horizontally from the printing position to the servicing position using a means for horizontal movement of the inkjet printhead, enabling a wiping process by bringing in contact a surface of the inkjet printhead and wiping elements during the horizontal movement of the printhead back and forth, the wiping elements being mounted on at least two frames, wherein each of the at least two frames comprises at least two of the wiping elements and a capping element for capping a corresponding one of the at least two MCM assemblies of the inkjet printhead, enabling capping, unclogging or purging processes in respect to the inkjet printhead by vertical movement of the inkjet printhead using a means for vertical movement of the inkjet printhead, wherein for each of the at least two frames, one of the at least two wiping elements is arranged on one end of the frame, which corresponds to one end of one row of chips of a corresponding one of the at least two MCM assemblies, and the other one of the at least two wiping elements is arranged on an opposite end of the frame, which corresponds to one end of an adjacent row of chips of the corresponding one of the at least two MCM assemblies, so that, during the wiping process, when one row of chips of one of the at least two MCM assemblies is wiped by one of the at least two wiping elements mounted on a corresponding frame of the at least two frames, the adjacent row of chips of said one of the at least two MCM assemblies is wiped by one of the at least two wiping elements mounted on an adjacent frame of the at least two frames.

14. The method according to claim 13, further comprising conveying the ink ejected by the nozzles during the capping, unclogging or purging processes to a waste ink tank in hermetic communication with the capping element.

15. The method according to claim 13, further comprising lowering the inkjet printhead along the vertical axis during the capping process and engaging the capping element.

* * * * *